United States Patent [19]

Ryan

[11] 4,118,057

[45] Oct. 3, 1978

[54] REUSABLE, TAMPER-INDICATING SEAL

[75] Inventor: Michael J. Ryan, Plainfield, Ill.

[73] Assignee: The United States of America as represented by the United States Department of Energy, Washington, D.C.

[21] Appl. No.: 880,924

[22] Filed: Feb. 24, 1978

[51] Int. Cl.[2] ..... E05C 19/18; B65A 33/34

[52] U.S. Cl. ..... 292/307 R; 70/440

[58] Field of Search ..... 292/325, 307 R, 307 A, 292/307 B; 24/205.11 R; 70/440

[56] References Cited

U.S. PATENT DOCUMENTS

| | | | |
|---|---|---|---|
| 102,696 | 5/1870 | McNair | 70/440 |
| 341,502 | 5/1886 | Powers et al. | 70/440 |
| 421,951 | 2/1890 | MacCarthy | 292/307 R |
| 721,926 | 3/1903 | Tyden | 292/325 |
| 851,644 | 4/1907 | Boan | 292/307 R |

*Primary Examiner*—J. Franklin Foss

*Attorney, Agent, or Firm*—Dean E. Carlson; Frank H. Jackson

[57] ABSTRACT

A reusable, tamper-indicating seal comprises a drum confined within a fixed body and rotatable in one direction therewithin, the top of the drum constituting a tray carrying a large number of small balls of several different colors. The fixed body contains parallel holes for looping a seal wire therethrough. The base of the drums carries cams adapted to coact with cam followers to lock the wire within the seal at one angular position of the drum. A channel in the fixed body — visible from outside the seal — adjacent the tray constitutes a segregated location for a small plurality of the colored balls. A spring in the tray forces colored balls into the segregated location at one angular position of the drum, further rotation securing the balls in position and the wires in the seal. A wedge-shaped plough removes the balls from the segregated location, at a different angular position of the drum, the wire being unlocked at the same position. A new pattern of colored balls will appear in the segregated location when the seal is relocked.

13 Claims, 7 Drawing Figures

FIG 2
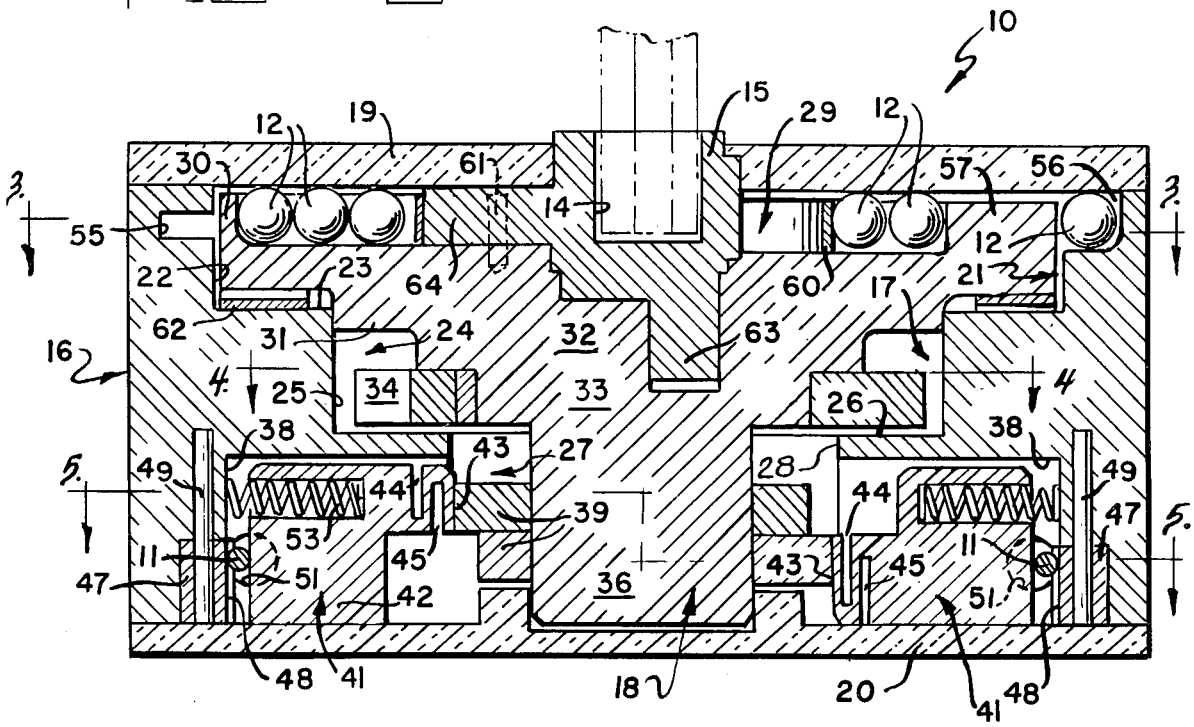
FIG 7
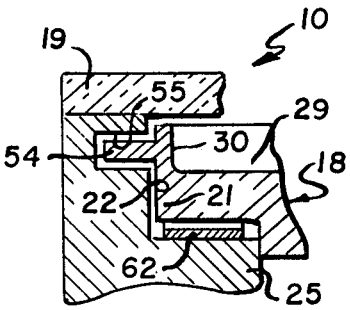
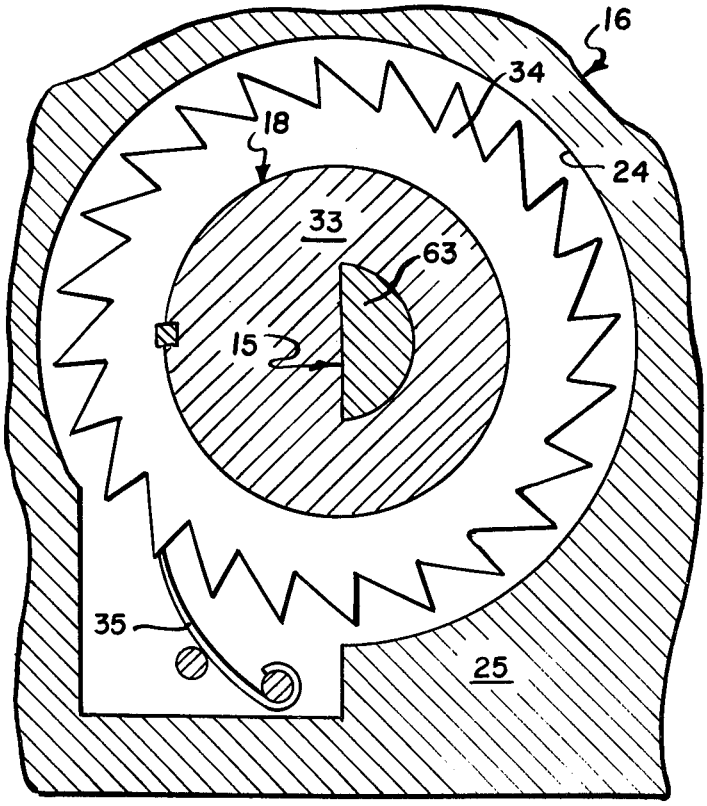
FIG 4

FIG 5
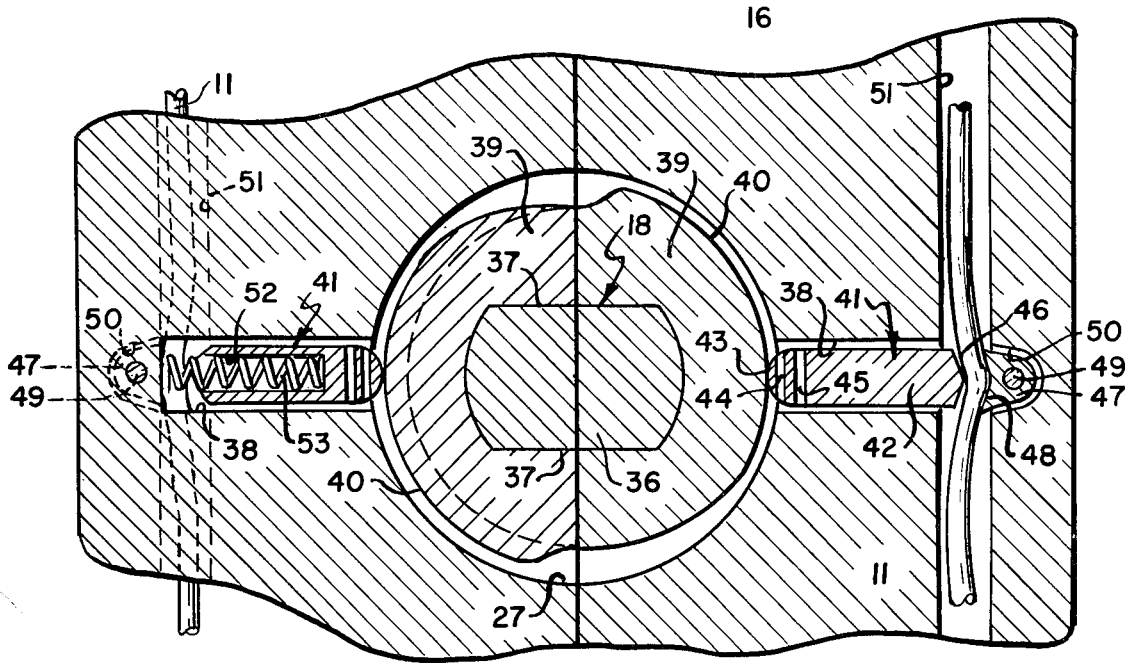
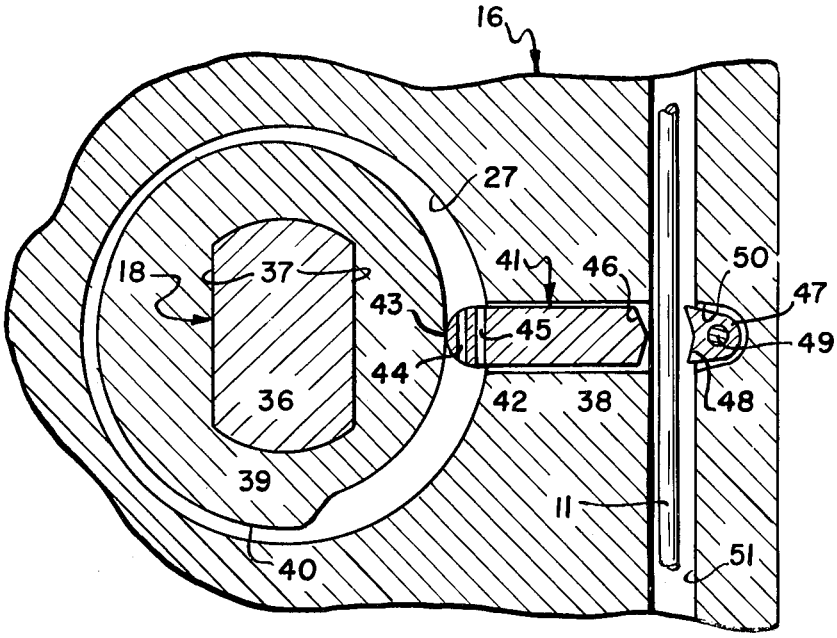
FIG 6

REUSABLE, TAMPER-INDICATING SEAL

CONTRACTUAL ORIGIN OF THE INVENTION

The invention described herein was made in the course of, or under, a contract with the United States Department of Energy.

BACKGROUND OF THE INVENTION

This invention relates to a seal. In more detail the invention relates to a reusable, tamper-indicating seal. In still more detail the invention relates to a seal constituting a fastener that serves as a check against tampering or unauthorized opening by clearly indicating within the seal if it has been opened.

Seals are employed on railway cars and other repositories of valuable materials as a safeguard against tampering or unauthorized opening. Conventional seals provide considerable assurance that unauthorized opening has not occurred. However such seals can be circumvented by anyone having access to a supply of seals by simply replacing a broken seal with a new one or counterfeiting seals would not be difficult for someone willing to go to considerable expense.

In some locations seals having a very high degree of required to indicate if unauthorized access has occurred. Seals presently employed for this purpose do have a high degree of integrity but at a relatively high cost both in time and money. To assure that a seal has not been replaced a plurality of random scratches are made on the interior of the seal and a picture thereof taken for recordation. When the seal is broken the pattern of scratches in the seal is compared with that in the records and an identical pattern indicates that the seal has not been replaced. This requirement for comparison is both expensive and time consuming. In addition the seal is destroyed when opened and since it cannot be reused a new seal must be installed.

SUMMARY OF THE INVENTION

The reusable, tamper-indicating seal of the present invention includes a large plurality of small balls of several different colors confined therein, means for locking a wire loop in the seal, means for segregating a small plurality of the colored balls in the seal in a location visible from outside the seal when the wire is locked in the seal and means for varying the pattern of balls in the segregated location when the seal is opened.

BRIEF DESCRIPTION OF THE DRAWING

FIG. 2 is a vertical sectional view on the line 2—2 of FIG. 1;

FIG. 4 is a horizontal sectional view on the line 4—4 of FIG. 2;

FIG. 5 is a horizontal sectional view on the line 5—5 of FIG. 2 with the seal in locked position.

FIG. 6 is a view similar to FIG. 5 with the seal in unlocked position; and

FIG. 7 is a detail section taken on the line 7—7 in FIG. 3

DETAILED DESCRIPTION OF THE INVENTION

Figure 3:
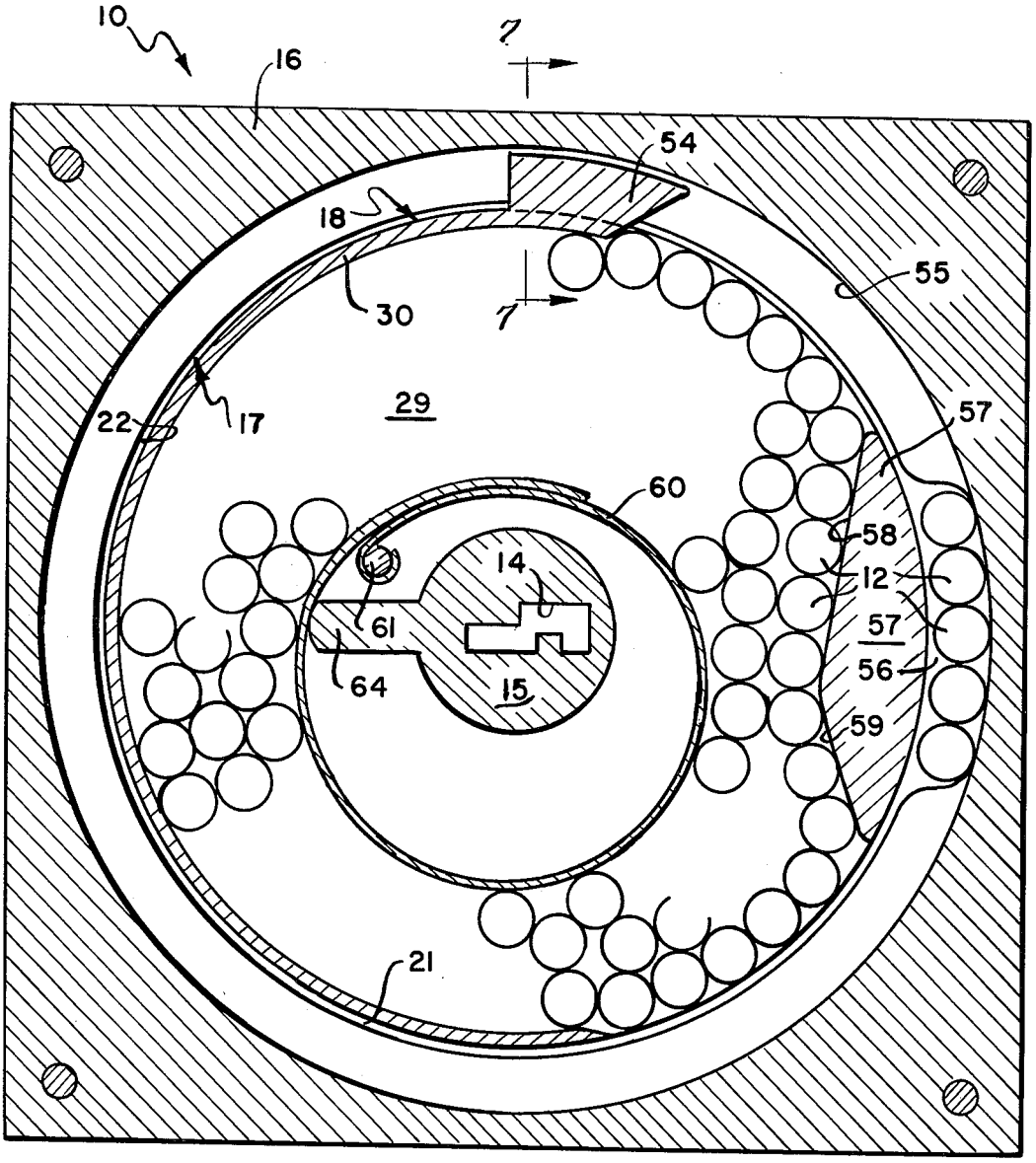
FIG. 3 is a horizontal sectional view on the line 3—3 of FIG. 2.
Figure 1:
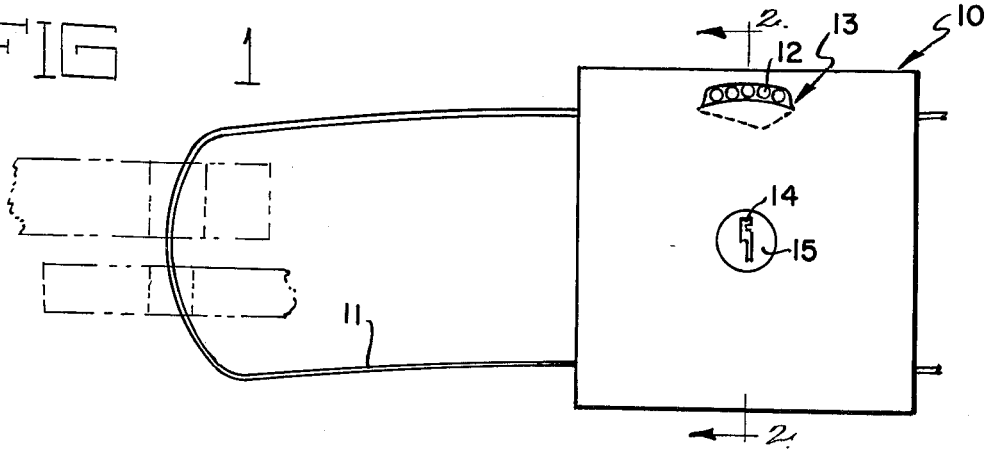
FIG. 1 is a sketch of a reusable, tamper-indicating seal according to the present invention having a wire loop locked therewithin.

Referring first to FIG. 1, seal 10, having a wire 11 looped therethrough, is shown in locked position and accordingly five small plastic balls 12 of different colors appear in a location 13 segregated from that of the remainder of a large number of such balls. At least these balls are visible from outside the seal as shown in the drawing. Preferably, however, the entire cover for the seal as well as other major components would be formed of a transparent material so that the internals of the seal can be observed when the seal is locked and unlocked in order to determine that it has not been tampered with and that it is functioning as designed.

A keyhole 14 extends into a cylinder 15 recessed into the seal. Turning a key in the keyhole unlocks the wire 11 from the seal and clears the plastic balls 12 from the segregated location 13. Completing a 360° turn of the key brings five different plastic balls in a different pattern into the segregated location and relocks the wire in the seal.

Referring now to FIGS. 2–7 of the drawing, seal 10 comprises a square body 16 having a stepped circular bore 17 extending completely through the body in which bore is rotatably disposed a stepped circular drum 18. Seal 10 is provided with a top cover 19 and a bottom cover 20 which are riveted to body 16.

Bore 17 includes a wide top portion 21 defined by a longitudinal wall 22 and a transverse ledge 23 extending about a third of the way into the body 16, a central, narrower portion 24 defined by a longitudinal wall 25 and a transverse ledge 26 extending a little less than a third of the way further into the body and a still narrow bottom portion 27 defined by a longitudinal wall 28 extending the remainder of the way through the body 16.

The top of drum 18 takes the form of a tray 29 provided with a rim 30 extending a little more than halfway around the drum. Tray 29 is disposed in wide top portion 21 of bore 17. Just below tray 29 is a short, narrower portion 31 extending into central portion 24 of bore 17 a short distance and mating with wall 25 thereof. An additional short narrower portion 32 extends further into central portion 27 of bore 17 while a still narrower portion 33 extends the remainder of the way to the bottom of central portion 24 of bore 17. A ratchet 34 is keyed on to still narrower portion 33 of drum 18 and cooperates with a pawl 35 (see FIG. 4) to prevent back rotation of drum 18. Finally a stem 36 having opposed flattened sides 37 (see FIGS. 5 and 6) extends into bottom portion 27 of bore 17.

A slot 38 having a length equal to the width of top wide portion 21 of bore 17 extends upwardly from the bottom of square body 16 to a height slightly less than the height of bottom portion 27 of bore 17 across the lower part of body 16 communicating with bottom portion 27 of bore 17.

Fitted on to stem 36 are a pair of identical cams 39 each having a single enlarged cam dwell 40 thereon, the cam dwells 40 being oriented 180° apart. Cam followers 41 are disposed in slot 38 and consist of essentially rectilinear, elongated blocks 42 each having a nose portion 43 at the inner end thereof which contact the cams 39. Nose portions 43 contain uppercuts 44 and undercuts 45 to provide a little resilience. The outer ends 46 of cam followers 41 are shaped in the form of a Vee which cooperates with a swivel 47 having a mating V-cut 48 therein to lock wire 11 therebetween. Swivel 47 is mounted on a post 49 and is disposed in an extension 50 of slot 38 which is only about half the height of slot 38. Wire 11 is looped through parallel holes 51 in body 16 which communicate with the outer ends of slot 38. At the top of cam followers 41 are recesses 52 containing springs 53 biased to urge cam followers 41 away from swivels 47.

Thus cam followers 41 are forced toward swivels 47 by cam dwells 40 to hold wire 11 in a very firm grasp thereby locking the wire within the seal. If an attempt is made to pull wire 11 out of the seal without unlocking the seal swivel 47 will rotate slightly and jam resisting very strongly such an attempt. When cam dwells 40 are turned away from swivels 47, springs 53 will urge cam followers 41 away from wire 11 so that the wire can easily be removed from the seal.

An important feature of the present invention is the indicia of tampering employed. For this purpose a large plurality — 60 in one embodiment — of small balls 12 of different colors are employed. According to one specific embodiment of the invention five different colors are employed there being an equal number of balls of each color. The colors should be selected so that there is little chance of confusion between colors and red, white, black, yellow and green would be suitable colors.

Balls 12 are normally held within tray 29 by rim 30, one end of which terminates in a wedge-shaped plough or code breaker 54 extending outwardly from rim 30 and riding in a circumferential slot 55 in wall 22 of bore 17. Wedge-shaped plough 54 has its point at the outer edge of slot 55. As shown slot 55 is smaller than are balls 12 except in an arc just large enough to receive five balls 12 wherein it is enlarged into a display channel 56. This channel constitutes location 13 for segregating a small plurality of the balls.

Halfway between code breaker 54 and the other end of rim 30 and fixed to tray 29 is a mixing wedge and code keeper 57 having a long leading edge 58 and a shorter trailing edge 59. Code keeper 57 is slightly longer than display channel 56. The outer edge of code keeper 57 is coterminous with the outer edge of tray 29. It will be appreciated that drum 18, rim 30, code breaker 54, code keeper 57 and possibly ratchet 34 and cams 39 are all cast as a single integral body and thus all rotate together. Typically the material may be a plastic.

Disposed in tray 29 is a coil spring 60 consisting of a metal band one end of which is secured to a pin 61 which is fastened to drum 18 and the other end of which is overlapping. Coil spring 60 holds balls 12 in a tight mass against rim 30, forces five balls 12 into display channel 56 when the path to do so is open and contracts when code breaker 54 removes the balls from display channel 56.

An annular spring 62 of any convenient form is disposed between ledge 23 and the bottom of tray 29. Since the balls 12 are slightly higher than the tray 29 is deep, the balls will thereby be held against the cover 19 and thus will rotate when the drum is rotated. This will assist in the mixing action.

Cylinder 15 includes a semicylindrical portion 63 which fits within a similarly shaped recess in the center of drum 18. Thus drum 18 will turn when a key is turned in keyhole 14. It will be appreciated that the key and keyhole are not employed for security but to prevent innocent fingers from operating the seal. A wing 64 extends out from the cylinder 15 in a direction longitudinal of the keyhole to sweep over the bottom of the tray and press against the pin 61 to cause the coil spring 60 to swing around in the tray in an eccentric orbit. Spring 60 and mixing edge 57 together with the cover 19 touching the balls 12 give a random mixing action to the balls as the drum is rotated.

In operation, the seal is coated with a clear plastic (not shown) about 1/10" thick leaving open only the key and wire holes. Underneath the plastic, and chemically bonded to it, is a seal serial number. The purpose of the cocoon of plastic is to prevent undetectable disassembly of the seal. Should the plastic be dissolved by a chemical solvent, the specially prepared serial number would also be destroyed.

The device has four modes:

1. Sealed — code fixed and visible — code recorded and witnessed in an official record system
2. Code destroyed
3. Seal open — wire may be removed
4. Seal closed — wire locked
5. New code generated and secured as in No. 1 — New code recorded and witnessed.

The four modes occur as the key is rotated through the quadrants; a different mode for each quadrant. The code consists of five colored balls displayed in a segregated position, each with the possibility of five different colors. Therefore the possible number of codes is 5 to the fifth power or 3,125 random possibilities.

It will be noted that the mixing wedge 57 not only assists in mixing the balls but also serves as code keeper since in the sealed mode the code keeper prevents any change in the code displayed.

The embodiments of the invention in which an exclusive property or privilege is claimed are defined as follows:

1. A tamper-indicating seal comprising a large plurality of small colored balls of different colors confined therein, means for locking a wire loop in the seal, means for segregating a small plurality of said small colored balls in the seal in a location visible from outside the seal and maintaining them in position when the wire loop is locked within the seal and means for removing the balls from the segregated location when the seal is opened and for mixing the balls whereby a different pattern of balls appears in the segregated location the next time the seal is locked.

2. Seal according to claim 1 wherein the seal comprises a drum rotatable in one direction only in a fixed body and said colored balls are carried in a tray constituting the top of the drum.

3. Seal according to claim 2 wherein the tray is provided with a rim extending a little more than halfway therearound, and with a code keeper fixed to the outer periphery of the tray and midway of the ends of the rim, and wherein the segregated location is a display channel in the fixed body adjacent the tray, the code keeper being slightly longer than the channel.

4. Seal according to claim 3 which includes a coil spring in the tray to force balls from the tray into the channel.

5. Seal according to claim 4 wherein the means for removing the balls from the segregated location comprises a wedge-shaped plough extending outwardly from the rim and attached to the end thereof.

6. Seal according to claim 5 wherein said body has parallel holes therein for looping a wire therethrough and said means for locking the wire in the seal includes cams fixed to the drum which coact with cam followers to wedge the wire within the body.

7. A seal (10) comprising a fixed body (16), a cover (19) therefor, a drum (18) rotatably carried therewithin, a ratchet (34) carried on said drum, a pawl (35) fixed to said body engageable with the ratchet to permit rotation thereof in one direction only, said body having parallel holes (51) for looping a wire therethrough, cam means (39) fixed to said drum, cam followers (41) movable by said cam means adapted to clamp the wire within the seal, the top of said drum constituting a tray (29), a large plurality of small differently colored plastic balls (12) in said tray, means (56, 57, 60,) for randomly segregating a small plurality of said balls in a position visible from outside the seal when the wire is clamped within the seal, and means (50) for positively removing said small plurality of balls from said segregated location when the wire is unclamped, and for assuring that a different arrangement of colored balls will appear in said segregated location the next time the wire is clamped in the seal.

8. Seal according to claim 7 wherein said means for randomly segregating a small plurality of said balls includes a coil spring (60) disposed in the tray, a wedge-shaped code keeper (57) fixed to the outer periphery of the tray, and a display channel (56) in said fixed body capable of receiving the said small plurality of balls.

9. Seal according to claim 7 wherein the means for positively removing the small plurality of balls from the segregated location comprises a wedge-shaped plough (54) extending outwardly from the periphery of the tray, adapted to ride in a slot (55) extending around the body and to remove the balls present in display channel (56).

10. Seal according to claim 7 and including a spring (62) biased to press the colored balls (12) up against the cover (19) whereby mixing action occurring by rotating the drum is enhanced.

11. Seal according to claim 7 wherein the cam means (39) consists of two cams oriented 180° apart, and the cam followers (41) comprise rectilinear blocks (42) having a nose portion (43) adapted to ride on the cams, said nose portions each including an undercut slot (45) and uppercut slot (44) to provide tolerance, and including a recess (52) and a spring (53) in the recess biased to force the cam followers against the cams.

12. Seal according to claim 11 wherein the end (46) of the cam follower opposite to the nose portion is V-shaped, said V-shaped end being adapted to drive the wire into a mating swivel (47) whereby pulling the locked wire out of the seal would cause the wire to jam against the swivel.

13. Seal according to claim 12 wherein the drum is rotated by a key in a keyhole (14) in a cylinder (15), said cylinder including a half cylindrical portion (63) inserted into the body of the drum, said cylinder (15) adapted to rotate the drum (18).

* * * * *

UNITED STATES PATENT OFFICE

CERTIFICATE OF CORRECTION

Patent No. 4,118,057 Dated October 3, 1978

Inventor(s) Michael J. Ryan

It is certified that error appears in the above-identified patent and that said Letters Patent are hereby corrected as shown below:

Column 1, line 27, before "required" insert --integrity are--. After "required" insert a period and the following: --For example, special nuclear materials must be safeguarded with a very high degree of assurance that no diversion of such materials to countries or individuals capable of using them to attain their own ends has occurred. Physical security is important for this purpose but since physical security cannot provide perfect assurance against loss, seals having a very high degree of integrity are also required--.

Column 4, line 3, change "edge" to --wedge--.

Signed and Sealed this

Fifth Day of June 1979

[SEAL]

*Attest:*

RUTH C. MASON
*Attesting Officer*

DONALD W. BANNER
*Commissioner of Patents and Trademarks*